US007510263B2

(12) United States Patent
Sakakitani

(10) Patent No.: US 7,510,263 B2
(45) Date of Patent: Mar. 31, 2009

(54) IMAGE FORMING APPARATUS

(75) Inventor: Masatoshi Sakakitani, Kanagawa (JP)

(73) Assignee: Ricoh Company, Ltd, Tokyo (JP)

( * ) Notice: Subject to any disclaimer, the term of this patent is extended or adjusted under 35 U.S.C. 154(b) by 449 days.

(21) Appl. No.: 11/209,498

(22) Filed: Aug. 22, 2005

(65) Prior Publication Data

US 2006/0050104 A1 Mar. 9, 2006

(30) Foreign Application Priority Data

Sep. 8, 2004 (JP) ..... 2004-260667

(51) Int. Cl.
*B41J 2/165* (2006.01)

(52) U.S. Cl. ..... 347/29; 347/22

(58) Field of Classification Search ..... 347/29–33
See application file for complete search history.

(56) References Cited

U.S. PATENT DOCUMENTS 5,635,965 A * 6/1997 Purwins et al. ..... 347/31

FOREIGN PATENT DOCUMENTS

| | | |
|---|---|---|
| JP | 2001-158143 | 6/2001 |
| JP | 2001-219618 | 8/2001 |
| JP | 2003-200570 | 7/2003 |

* cited by examiner

*Primary Examiner*—Manish S Shah
(74) *Attorney, Agent, or Firm*—Cooper & Dunham, LLP

(57) ABSTRACT

An image forming apparatus is disclosed that includes a maintenance recovery mechanism for maintaining and restoring a condition of a recording head. An opening larger than an outline of a frame of the maintenance recovery mechanism is formed in a side plate to which an end of a guide rod is attached. The frame of the maintenance recovery mechanism is secured and held at the upper side of the opening. The maintenance recovery mechanism can be removed in a scanning main direction through the opening of the side plate.

6 Claims, 9 Drawing Sheets

IMAGE FORMING APPARATUS

BACKGROUND

1. Technical Field

The invention disclosure relates to an image forming apparatus, and particularly relates to a recording head that ejects recording ink.

2. Description of the Related Art

Inkjet recording apparatuses are used as image forming apparatuses such as printers, fax machines, copy machines, and plotters. A serial type image forming apparatus is one of the inkjet recording apparatuses, and is configured to form (records) images on a medium to be recorded on (which includes recording paper, transfer paper and other recording media and is hereinafter referred to as "sheet" although the material is not limited to paper) using a droplet ejection head or a recording head that is mounted on a carriage for ejecting recording liquid (e.g. ink) from a nozzle while moving the carriage in a main scanning direction.

This type of inkjet recording apparatus has been mainly used as a single-function apparatus such as a printer for personal use. If a carriage of such an inkjet recording apparatus having a recording head mounted thereon gets out of order, the apparatus is sent to a repair shop so as to be disassembled for repairing or replacing the carriage.

In these years, so-called multi-function image forming apparatuses having two or more of a printer function, a fax machine function, and a copy machine function are being developed and coming into practical use. Different from single-function apparatuses, multi-function type image forming apparatuses can not be easily sent to repair shops. Therefore, multi-function apparatuses are preferably configured such that a service person can make repairs on-site by replacing parts.

An example of image forming apparatuses that allow part replacement is disclosed in Patent Document 1, which comprises detachable plural blocks. Each block is responsible for a specific function and has connection means to be connected to the other blocks. The blocks are classified into plural groups according to the configuration of the connection means. The blocks in the same groups have the same type connection means. One block having a desired function is selected from each group, and the selected blocks are connected to each other through the connection means.

[Patent Document 1] Japanese Patent Laid-Open Publication No. 2001-219618

In the above-described image forming apparatus, a maintenance recovery mechanism for maintaining and restoring a condition of a recording head is formed as a block integral with a recovery block including a suction cap, a blade, a recovery motor, and a recovery pump. The recovery block can be removed by being pulled out to the upper side from the apparatus body.

Generally, in image forming apparatuses provided with a carriage having a recording head mounted thereon, a guide rod (guide shaft) for guiding the carriage in a main scanning direction is provided to extend between a pair of opposing side plates, and a maintenance recovery mechanism for maintaining and restoring a condition of the recording head is arranged under the guide rod.

[Patent Document 2] Japanese Patent Laid-Open Publication No. 2001-158143

As a method for locating a home position of a carriage, a system as disclosed in Patent Documents 2 and 3 is often employed. This system causes a carriage to hit against a side plate holding an end of a guide rod and, with reference to this hitting position, move the carriage to a home position by performing predetermined operations.

[Patent Document 3] Japanese Patent Laid-Open Publication No. 2003-200570

Turning back to the image forming apparatus disclosed in Patent Document 1, when the recovery block is removed for the purpose of replacement (including repair), a carriage block integrally including a carriage and a guide shaft needs to be removed before removing the recovery block. This is because the image forming apparatus is configured such that the recovery block is removed via the upper side. Similarly, in the case of the image forming apparatus disclosed in Patent Document 2, it is impossible to remove only the maintenance recovery mechanism.

As can be seen, the image forming apparatuses as described above are not designed with enough consideration for on-site maintenance, and are not convenient from the standpoint of maintenance.

BRIEF SUMMARY

The present disclosure provides an image forming apparatus on which maintenance can be performed with ease.

According to an aspect of the present disclosure, in an image fanning apparatus, an opening larger than an outline of a frame of a maintenance recovery mechanism is formed in a side plate, to which a guide rod is attached, such that the maintenance recovery mechanism can be removed through the opening.

Preferably, the frame of the maintenance recovery mechanism is detachably secured to the side plate at the upper side of the opening. It is also preferable that an end of the guide rod be attached to the side plate at the upper side of the opening. It is also preferable that a cover of an apparatus body be detachably attached to an outer side of the side plate. The image forming apparatus preferably further comprises an image reading unit, and an image forming unit including a recording head.

In above-described image forming apparatus, because the opening larger than the outline of the frame of the maintenance recovery mechanism is formed in the side plate to which the guide rod is attached, the maintenance recovery mechanism can be removed to the outside through the opening. Therefore, the maintenance of the image forming apparatus can be performed with ease.

DETAILED DESCRIPTION OF PREFERRED EMBODIMENT

Figure 1:
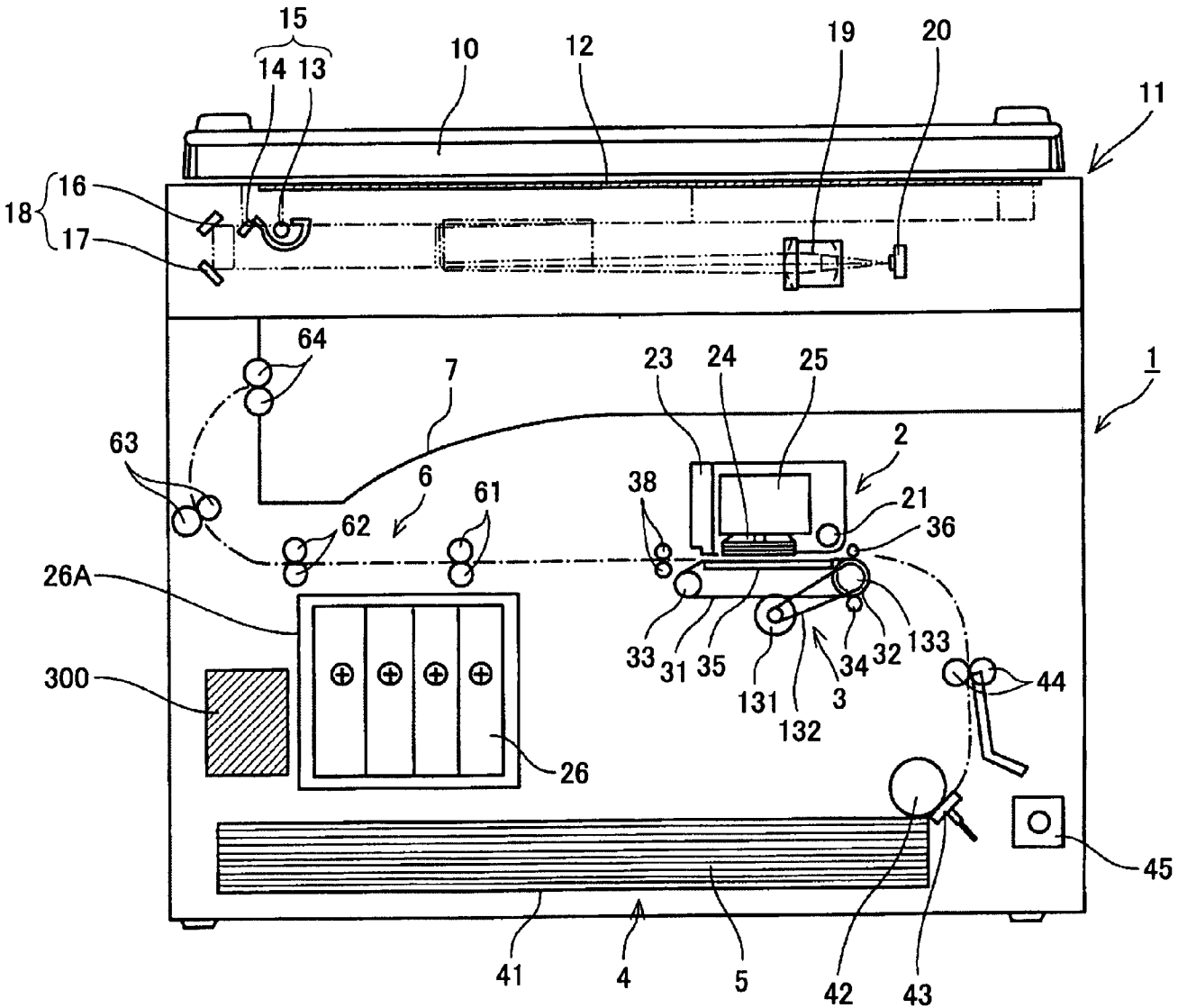
FIG. 1 is a schematic diagram illustrating a configuration example of an image forming apparatus according to the present invention.
Figure 2:
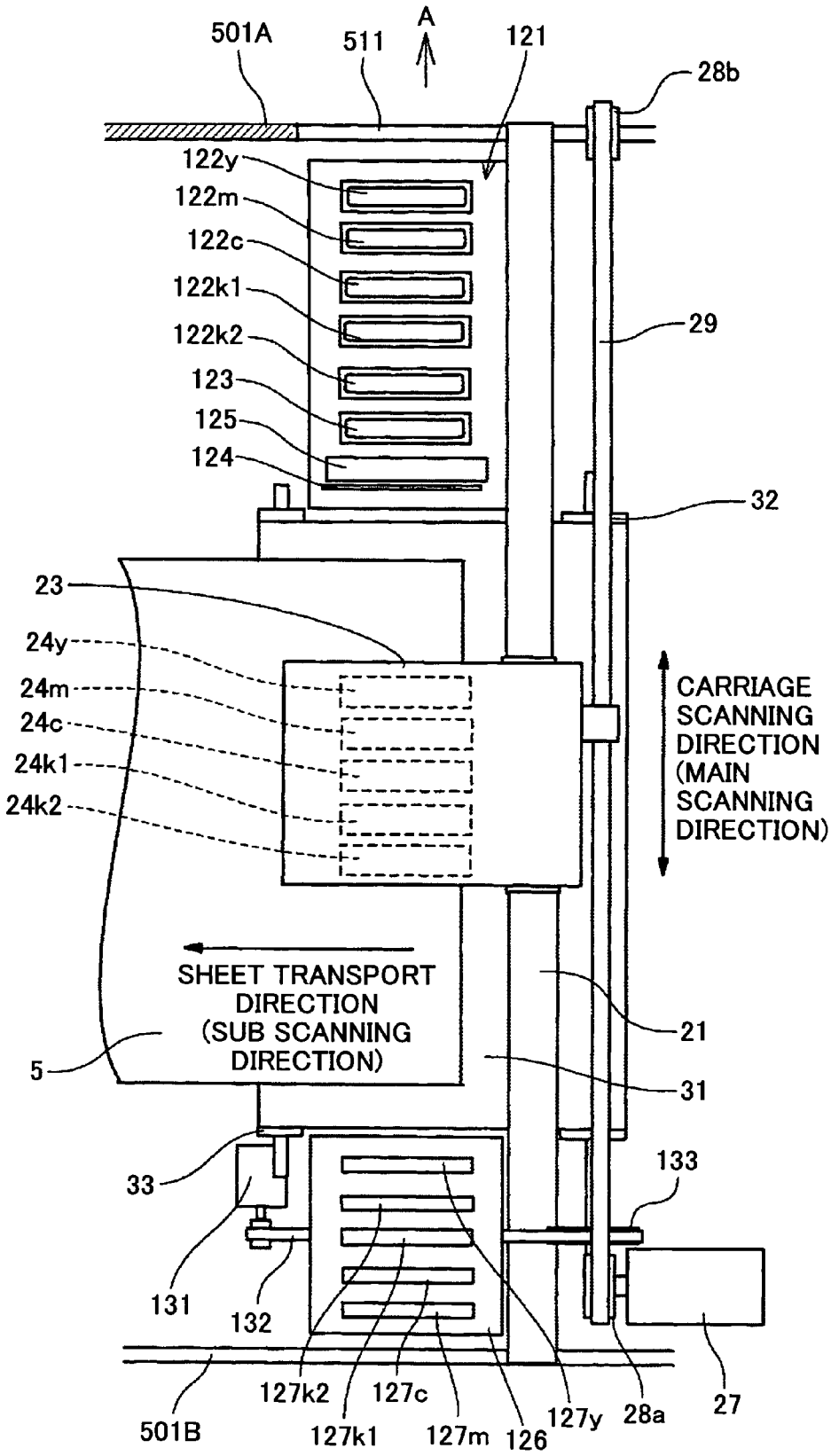
FIG. 2 is a schematic diagram illustrating an image forming section and a sub scanning transport section of the image forming apparatus.
Figure 3:
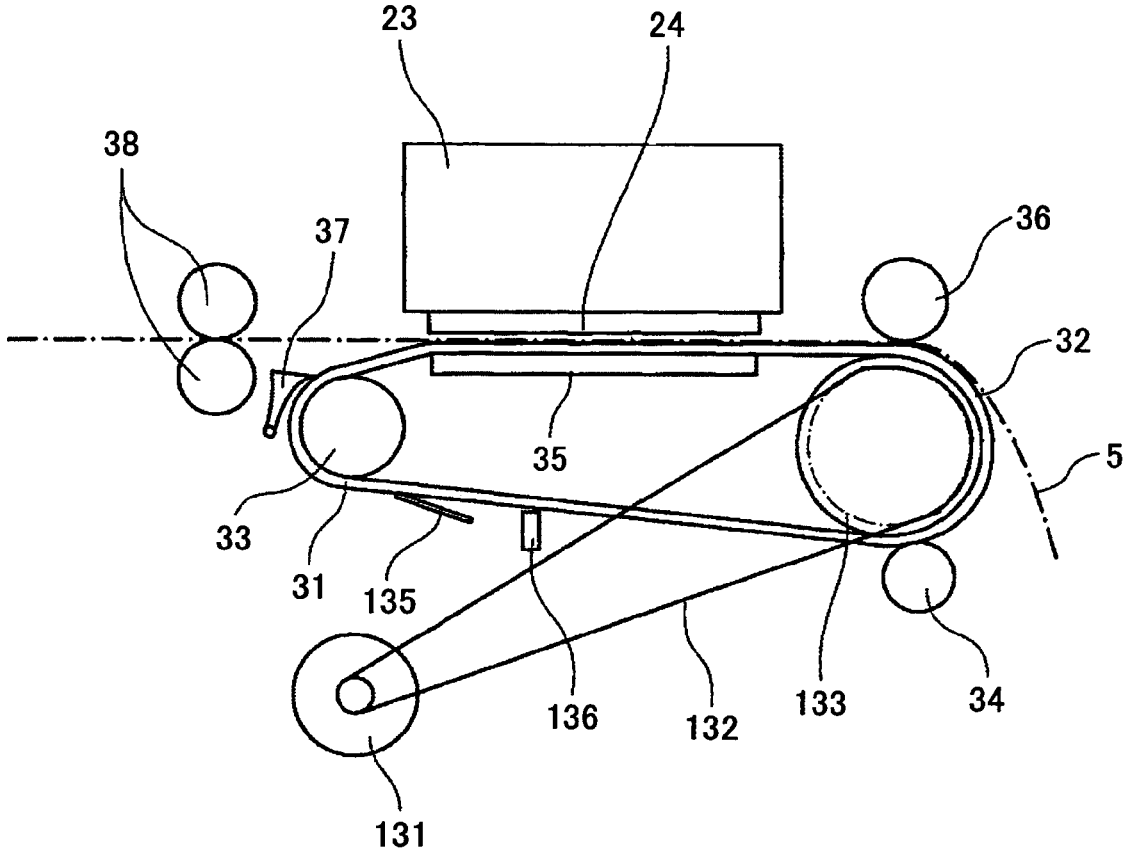
FIG. 3 is a detailed view of the sub scanning transport section.

In the following description, provides examples and exemplary embodiments of the present invention are provided with reference to the accompanying drawings. An example of an image forming apparatus according to the present invention is described below referring to FIGS. 1 through 4. FIG. 1 is a schematic diagram illustrating the configuration of the image forming apparatus. FIG. 2 is a schematic diagram illustrating an image forming section 2 and a sub scanning transport section 3 of the image forming apparatus. FIG. 3 is a side view of the sub scanning transport section.

In this image forming apparatus, the image forming section (unit) 2 for forming images and the sub scanning transport section (unit) 3 are provided inside (in a casing) of an apparatus body 1. A sheet feed section (unit) 4 disposed at the bottom of the apparatus body 1 feeds a medium 5 to be recorded on as a member to be transported (hereinafter referred to as "sheet" although the material is not limited to paper) one by one. The sheet 5 is intermittently transported by the sub scanning transport section 3 while facing the image forming section 2. The image forming section 2 ejects droplets onto the sheet 5 to form (record) images thereon. The sheet 5 is then ejected to a catch tray 7 provided on an upper face of the apparatus body 1 through a sheet eject transport section 6.

The image forming apparatus comprises an image reading section (scanner section) 11 adapted to read images at the upper part of the apparatus body 1 on the upper side of the catch tray 7. The image reading section 11 serves as an input system for inputting image data (print data) to be formed by the image forming section 2. In the image reading section 11, a scanning optical system 15 including an illumination light source 13 and a mirror 14 and another scanning optical system 18 including mirrors 16 and 17 move to read images of a document placed on a contact glass 12, and the scanned document is read as image signals by an image reading element 20 arranged at the rear side of a lens 19. The read image signals are digitized and processed into print data, and the print data are printed out. A pressure plate 10 for holding the document is provided on the contact glass 12.

The image forming apparatus can receive print data including image data through a cable or a network from host devices, i.e., information processing devices such as personal computers, image reading devices such as image scanners, and imaging devices such as digital cameras. The received print data are processed and printed out.

Referring to FIG. 2, in the image forming section 2 of the image forming apparatus, a carriage 23 is held by a guide rod 21 and a guide stay (not shown) so as to be movable in a main scanning direction. The carriage 23 is moved in the main scanning direction by a main scanning motor 27 through a timing belt 29 extending around a drive pulley 28*a* and a driven pulley 28*b*.

A recording head 24 is installed on the carriage 23. While the carriage 23 is reciprocally moved in the main scanning direction, the recording head 24 ejects droplets so as to form images on the sheet 5 being transported in a sheet transport direction (sub scanning direction) by the sub scanning transport section 3.

The recording head 24 comprises five droplet ejection heads, i.e., two droplet ejection heads 24*k*1 and 24*k*2 for ejecting a black (Bk) ink, and droplet ejection heads 24*c*, 24*m*, and 24*y* for ejecting a cyan (C) ink, a magenta (M) ink, and a yellow (Y) ink, respectively (hereinafter the droplets ejection heads are referred to as simply "heads"). The inks are supplied from corresponding sub-tanks 25 (FIG. 1) mounted on the carriage.

Referring back to FIG. 1, ink cartridges 26 storing the black (K) ink, the cyan (C) ink, the magenta (M) ink, and the yellow (Y) ink, respectively, are detachably attached to a cartridge mount section 26A from the front side of the apparatus body 1. The inks in the ink cartridges 26 are supplied to the corresponding sub-tanks 25. The black ink is supplied from one of the ink cartridges 26 to the two of the sub-tanks 25.

The type of recording head 24 applicable herein includes: a piezo type head that applies pressure to ink in an ink passage (pressure generation chamber) by using a piezoelectric element provided as a pressure generating unit (actuator unit), deforms a wall of the ink passage, changes the volume of the ink passage, and thus ejects ink droplets; a thermal type head that heats ink in an ink passage to form bubbles by using a heating element, and thus ejects the ink with pressure generated by the formation of the bubbles; and an electrostatic type head that provides a diaphragm on a wall of an ink passage and an electrode opposing the diaphragm, deforms the diaphragm with static electricity generated between the diaphragm and the electrode, changes the volume of the ink passage, and thus ejects ink droplets.

With reference to FIG. 2, a maintenance recovery mechanism 121 including a head cleaning unit for maintaining and restoring the condition of a nozzle of the recording head 24 is provided in a non-printing area located at one side in a scanning direction of the carriage 23. The maintenance recovery mechanism 121 comprises five dry-proof caps 122*k*2, 122*k*1, 122*c*, 122*m* and 122*y* (which are referred to as "dry-proof caps 122" if ignoring the colors thereof) for capping nozzle faces of the recording head 24, a suction cap 123, a wiper blade 124 for wiping the nozzle faces of the recording head 24, an idle ejection receiver 125 for idle ejection not intended to record (form) images, and a carriage block member (not shown).

Another idle ejection receiver (idle ejection receiving member) 126 for idle ejection not intended to record (form) images is provided in a non-printing area located at the other side in the scanning direction of the carriage 23. The idle ejection receiver 126 has five openings 127*k*2, 127*k*1, 127*c*, 127*m*, and 127*y* (which are referred to as "openings 127" if ignoring the colors thereof) corresponding to the recording head 24.

The sub scanning transport section 3 comprises a transport roller 32 as a drive roller for changing a transport direction of the sheet 5 fed from the lower side by 90 degrees such that the sheet 5 is transported facing the image forming section 2, a driven roller 33, an endless transport belt 31 extending around the transport roller 32 and the driven roller 33, a charging roller 34 as a charging unit to which a high voltage (alternating current) is applied from a high-voltage power supply in order to charge the surface of the transport belt 31, a guide member 35 that guides the transport belt 31 within an area opposing the image forming section 2, a pressure roller 36 that presses the sheet 5 against the transport belt 31 at a position opposing the transport roller 32, a separation claw 37 that separates the sheet 5 on which images are formed from the transport belt 31, and transport rollers 38 that send the sheet 5 separated from the transport belt 31 to the sheet eject transport section 6.

Referring to FIG. 3, as the transport roller 32 is rotated through a timing belt 132 and the timing roller 133 by the sub scanning motor 131, the transport belt 31 of the sub scanning transport section 3 is rotated to transport the sheet 5 in the sheet transport direction (sub scanning direction) of the single-headed arrow in FIG. 2. Although the transport belt 31 has a double layer structure including a front surface (sheet adhesion face) made of a pure resin material, such as pure ETFE material, with no resistance control, and a back side (middle resistance layer, grounding layer) made of the same material as the front layer but with resistance control by carbon, the transport belt 31 may have a single layer structure or a structure having three or more layers.

A cleaning unit (made of Mylar (trademark) in this embodiment) 135 for removing paper powder adhered on the surface of the transport belt 31 and a discharging brush 136 for discharging the surface of the transport belt 31 are provided between the driven roller 33 and the charging roller 34.

The sheet feed section 4, which can be loaded into and unloaded from the apparatus body 1, comprises a sheet cassette 41 for stacking and storing multiple sheets 5 therein, a sheet feed roller 42 and a friction pad 43 for sending the sheets 5 stored in the sheet cassette 41 one by one, and a sheet feed transport roller 44 for transporting the sheet 5 to the sub scanning transport section 3. The sheet feed roller 42 is rotated by a sheet feed motor (drive source) 45 including an HB stepping motor through a sheet feed clutch (not shown). The sheet feed transport roller 44 is also rotated by the sheet feed motor 45.

The sheet eject transport section 6 comprises sheet eject transport roller pairs 61 and 62 for transporting the sheet 5 on which images are formed, and sheet eject transport roller pairs 63 and 64 for sending the sheet 5 to the catch tray 7.

Figure 4:
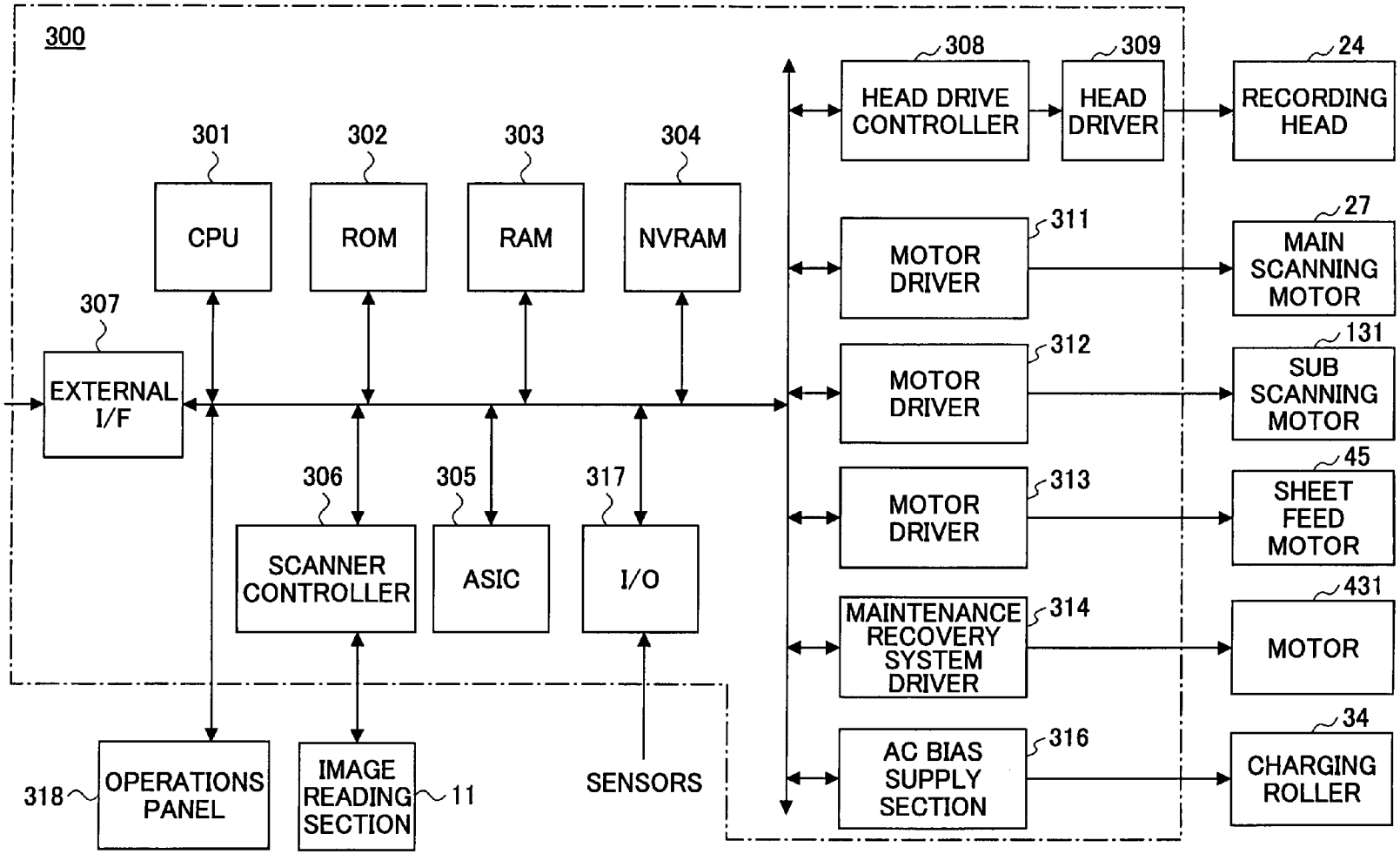
FIG. 4 is a block diagram illustrating a control section of the image forming apparatus.

The following section provides an overview of a control section 300 of the image forming apparatus with reference to FIG. 4.

The control section 300 comprises a CPU 301 that controls the apparatus, a ROM 302 storing programs executed by the CPU 301 and other fixed data, a RAM 303 that temporarily stores image data and the like, a nonvolatile memory (NVRAM) 304 that retains data even when power is removed, an ASIC 305 that processes various signals for image data and processes input/output signals for processing or reordering images and for controlling the apparatus, and a scanner controller 306.

The control section 300 section further comprises an I/F 307 that transmits and receives signals and data to and from the host devices, a head drive controller 308 and a head driver 309 that control and drive the recording head 24, a main scanning motor driver 311 that drives the main scanning motor 27, a sub scanning motor driver 312 that drives the sub scanning motor 131, a sheet feed motor driver 313 that drives the sheet feed motor 45, a maintenance recovery system driver 314 that drives a motor 431 (described below) for operating the maintenance recovery mechanism 121, an AC bias supply section 316 that supplies a varying voltage (rectangular wave) as a power for enabling the charging roller 34 to charge the transport belt 31, and other components (not shown) that drive motors for an ink supply system and clutches including the sheet feed clutch.

The control section 300 further comprises an I/O 317 for inputting detection signals thereinto from various sensors such as a print start sensor that detects, in the upstream of the recording head 24, the sheet 5 which has passed through between the transport roller 32 and the pressure roller 36, a print end sensor that detects the sheet 5 downstream of the transport rollers 38, a home position sensor (not shown) of the maintenance recovery mechanism 121, a sensor that detects ambient temperature and humidity, and a sensor that detects a cover of the apparatus being opened. An operations panel 318 that inputs necessary information to the apparatus and displays information is connected to the control section 300.

The control section 300 receives, at the I/F 307, print data through a cable or a network from the host devices, i.e., information processing devices such as personal computers, image reading devices such as image scanners, and imaging devices such as digital cameras.

The CPU 301 reads and analyzes the print data held in a receive buffer of the I/F 307. Then, the ASIC 305 performs image processing and data reordering and sends image data to the head drive controller 308. Dot pattern data for outputting images may be generated using font data, which may be stored in the ROM 302. Alternatively, image data may be expanded into bit map data by a printer driver at a host side before being transmitted to the apparatus.

The head drive controller 308 receives image data (dot pattern data) corresponding to one line for the recording head 24, and sends the received dot pattern data corresponding to one line as serial data to the head driver 309 synchronously with clock signals. The head drive controller 308 also sends latch signals to the head driver 309 with a predetermined timing. The head drive controller 308 comprises a ROM (or the ROM 302) storing pattern data of drive waveforms (drive signals), and a drive waveform generation circuit including an amplifier and a waveform generation circuit having a D/A converter for performing D/A conversion of the data of drive waveforms read from the ROM.

The head driver 309 comprises a shift register that inputs the clock signals and the serial data as the image data from the head drive controller 308, a latch circuit that latches the registration value of the shift register with the latch signals from the head drive controller 308, a level change circuit (level shifter) that changes the level of the output value of the latch circuit, and an analog switch array (switch unit) that is turned on/off by the level shifter. By turning on/off the analog switch array, a desired drive waveform included in the drive waveforms is selectively applied to the actuator unit of the recording head 24 to drive the recording head 24.

The control section 300 causes the AC bias supply section 316 to apply a predetermined variable voltage to the charging roller 34 such that the charging roller 34 charges the transport belt 31 to generate a predetermined attraction force for attracting the sheet 5 when the transport belt 31 transports the sheet 5. Also, at a predetermined timing, the control section 300 causes the AC bias supply section 316 to apply another predetermined variable voltage (or a frequency) to the charging roller such that the charging roller 34 charges the transport belt 31 to generate an attraction force smaller than an attraction force to be generated without the variable voltage being applied.

In the image forming apparatus with the above-described configuration, the charging roller 34 abuts an insulating layer (front layer) of the transport belt 31 when a bipolar rectangular wave high voltage as an variable voltage is applied from the AC bias supply section 316 to the charging roller 34. Therefore, positive charges and negative charges are alternately applied to the front layer of the transport belt 31 in the transport direction of the transport belt 31 so as to form charged strips with a predetermined width. As a result, a non-uniform electric field is formed on the transport belt 31.

When the sheet 5 sent from the sheet feed section 4 passes through between the transport roller 32 and the pressure roller 36 onto the transport belt 31 on which the non-uniform electric field is generated by positive and negative charges, the sheet 5 is instantaneously polarized along a direction of the electric field and is adhered onto the transport belt 31 due to an electrostatic attraction force. Thus, the sheet 5 is transported along with the movement of the transport belt 31.

While the sheet 5 is intermittently transported by the transport belt 31, the recording head 24 ejects droplets of the recording liquid to record (print) images on the sheet 5. After the image is printed on the sheet 5, the separation claw 37 separates the front end of the sheet 5 from the transport belt 31 so that the sheet 5 is sent to the sheet eject transport section 6 by the transport rollers 38.

The carriage 23 is moved to and stays at the side of the maintenance recovery mechanism 121 while standing by for a printing operation. An ejection hole face of the recording head 24 is capped by the dry-roof caps 122 for keeping an ejection hole section wet, thereby preventing poor ejection due to ink dryout. The recording head 24 performs idle ejection or ejects ink during a recording operation not for recording images but for equalizing the viscosity of the inks in all the ejection holes so as to maintain stable ejection performance.

If the ejection performance is lowered, an ejection hole (nozzle) of the recording head 24 is tightly capped by the suction cap 123. Then, a suction unit suctions ink and bubbles from the ejection hole through a tube, and the cleaning unit removes ink and dust adhered to the ejection hole face. In this way, the ejection performance is restored. The suctioned ink is discharged to a waste ink reservoir arranged at the lower part of the apparatus body, and absorbed by an ink absorber in the waste ink reservoir.

Figure 5:
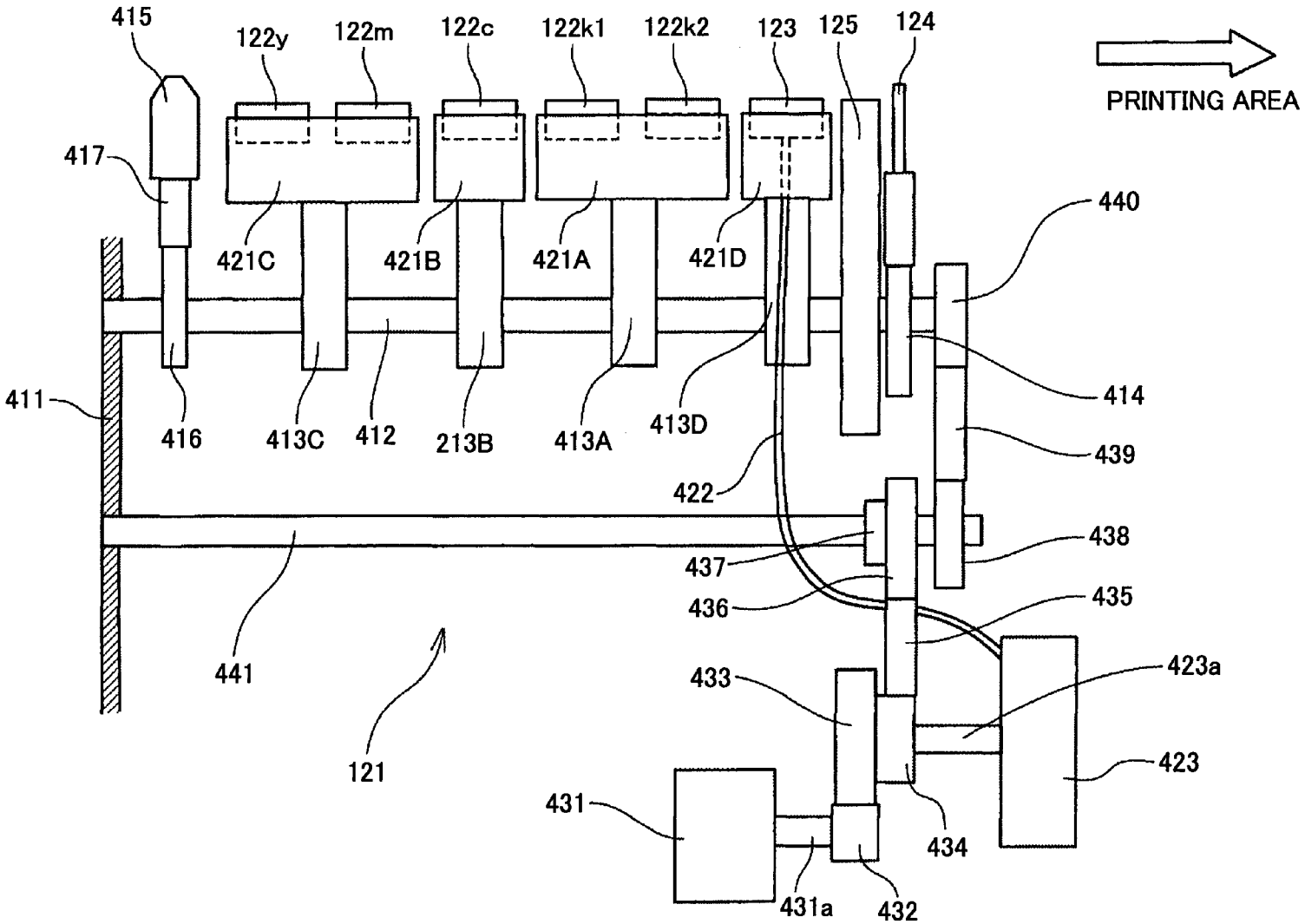
FIG. 5 is a schematic diagram illustrating a maintenance recovery mechanism of the image forming apparatus.
Figure 6:
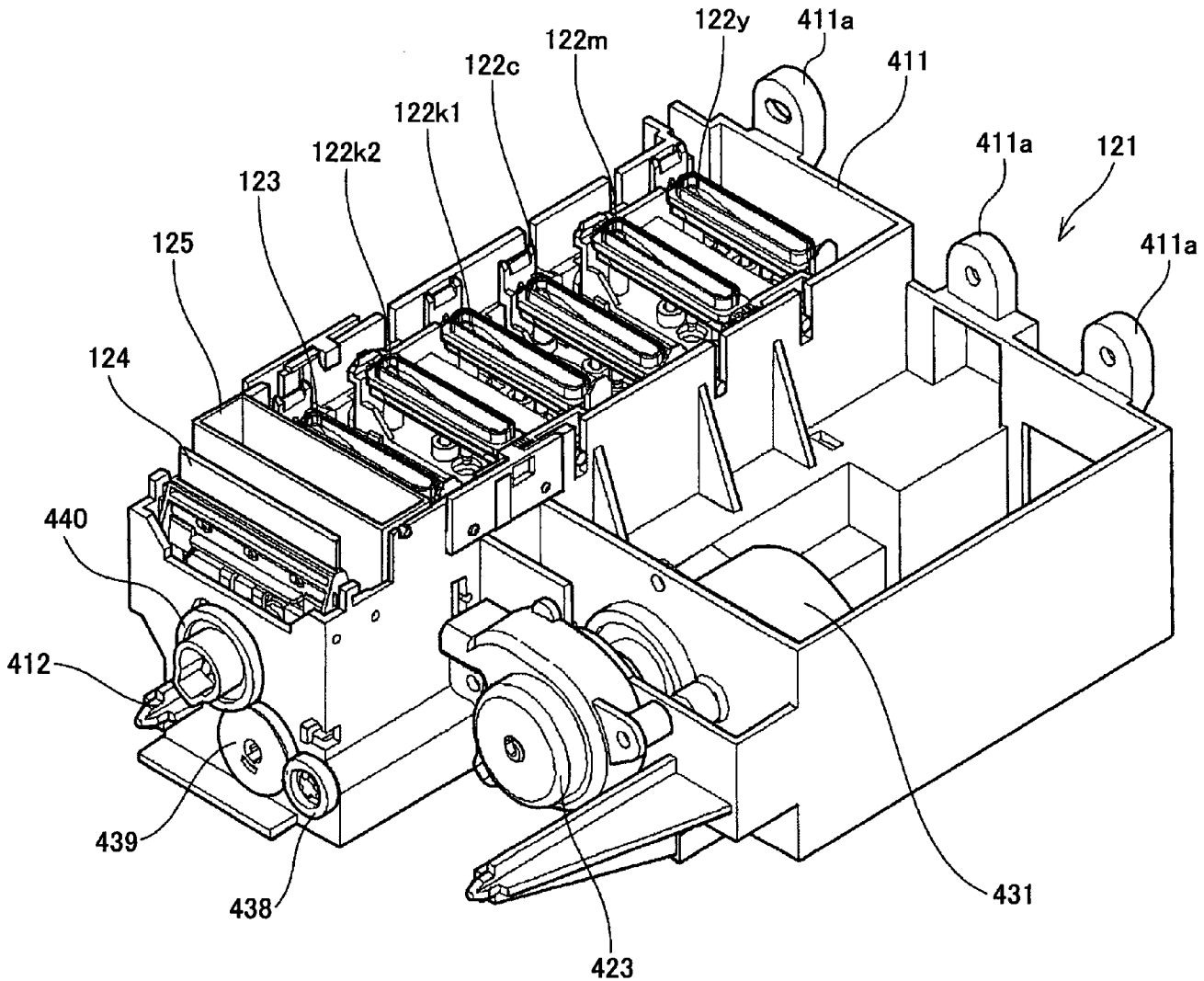
FIG. 6 is a perspective view of the maintenance recovery mechanism.

The maintenance recovery mechanism 121 of the image forming apparatus is described below in detail with reference to FIG. 5 and FIG. 6. FIG. 5 is a schematic illustration of the maintenance recovery mechanism 121, and FIG. 6 is a perspective view of the maintenance recovery mechanism 121.

The maintenance recovery mechanism 121 comprises cap holders 421A through 421D including a holder mechanism that holds the dry-proof caps 122 and the suction cap 123 (cap holders 421A and 421C each include two dry-proof caps 122), the wiper blade 124 which is an elastic blade serving as a cleaning unit for cleaning (wiping) a nozzle face of the recording head 24, and the idle ejection receiver 125 for idle ejection of droplets performed by the recording head 24 which is not intended to print images.

The suction cap 123 held by the cap holder 421D, which is the cap closest to a printing area, is connected to a tubing pump (suction pump) 423 provided as a suction unit through a flexible tube 422. For performing a maintenance recovery operation of the recording head 24, one of the heads of the recording head 24 to have a recovery operation is moved to a position where it can be capped by the suction cap 123.

A cam shaft 412 rotatably held by a frame 411 is arranged under the cap holders 421A through 421D. Cap cams 413A through 413D for lifting/lowering the cap holders 421A through 421D and a wiper cam 414 for lifting/lowering the wiper blade 124 are attached to the cam shaft 412. Although the upper dead centers of the dry-proof caps 122 and the suction cap 123 are located at different heights, the dry-proof caps 122, the suction cap 123, and the cams 413A through 413D are located at the same height in FIG. 5 for simplification of the drawing.

A carriage lock 415 that engages and locks the movement of the carriage 23 is provided. The carriage lock 415 is biased upward (in a locking direction) by a compression spring (not shown), and is lifted/lowered through a carriage lock arm 417 driven by a carriage lock cam 416 attached to the cam shaft 412.

The tubing pump 423 and the cam shaft 412 are driven by having the following configuration. The motor 431 transfers its torque to a motor gear 432 attached to a motor shaft 431*a*. The motor gear 432 meshes with a gear 433 attached to a pump shaft 423*a* of the tubing pump 423. A gear 434 integrally provided with the gear 433 meshes with a middle gear 436 having a one-way clutch 437 through a middle gear 435. A middle gear 438 coaxially provided with the middle gear 436 meshes with a cam gear 440 fixed to the cam shaft 412 through a middle gear 439.

In this maintenance recovery mechanism 121, when the motor 431 rotates in a normal rotational direction, the motor gear 432, the gears 433 and 434 and the middle gears 435 and 436 are rotated. When the shaft 423*a* of the tubing pump 423 is rotated, the tubing pump 423 is operated to take suction inside the suction cap 123 (this operation is referred to as "cap inside suction"). The gears 438 through 439 are not rotated because the rotation is blocked by the one-way clutch 437.

On the other hand, when the motor 431 rotates in the opposite direction, the one-way clutch 437 is connected. Therefore, the rotation of the motor 431 is transmitted to the cam gear 440 trough the motor gear 432, the gears 433 and 434 and the middle gears 435 and 436. As a result, the cam shaft 412 is rotated. The tubing pump 423 is configured to not rotate while the pump shaft 423*a* is rotated in the opposite direction.

As previously mentioned, the recording head 24 is moved to a position where the recording head 24 of the carriage 23 is opposed by the corresponding dry-proof caps 122. Then the cam shaft 412 is driven so the nozzle face of the recording head 24 is capped by the dry-proof caps 122. When a recovery operation of the recording head 24 is performed, one of the heads the recording head 24 to have the recovery operation is moved to a position opposing the suction cap 123. Then, the cam shaft 412 is rotated such that the suction cap caps the nozzle face of the recording head 24, and the tubing pump 423 suctions inside the ejection hole of the recording head 24.

Figure 7:
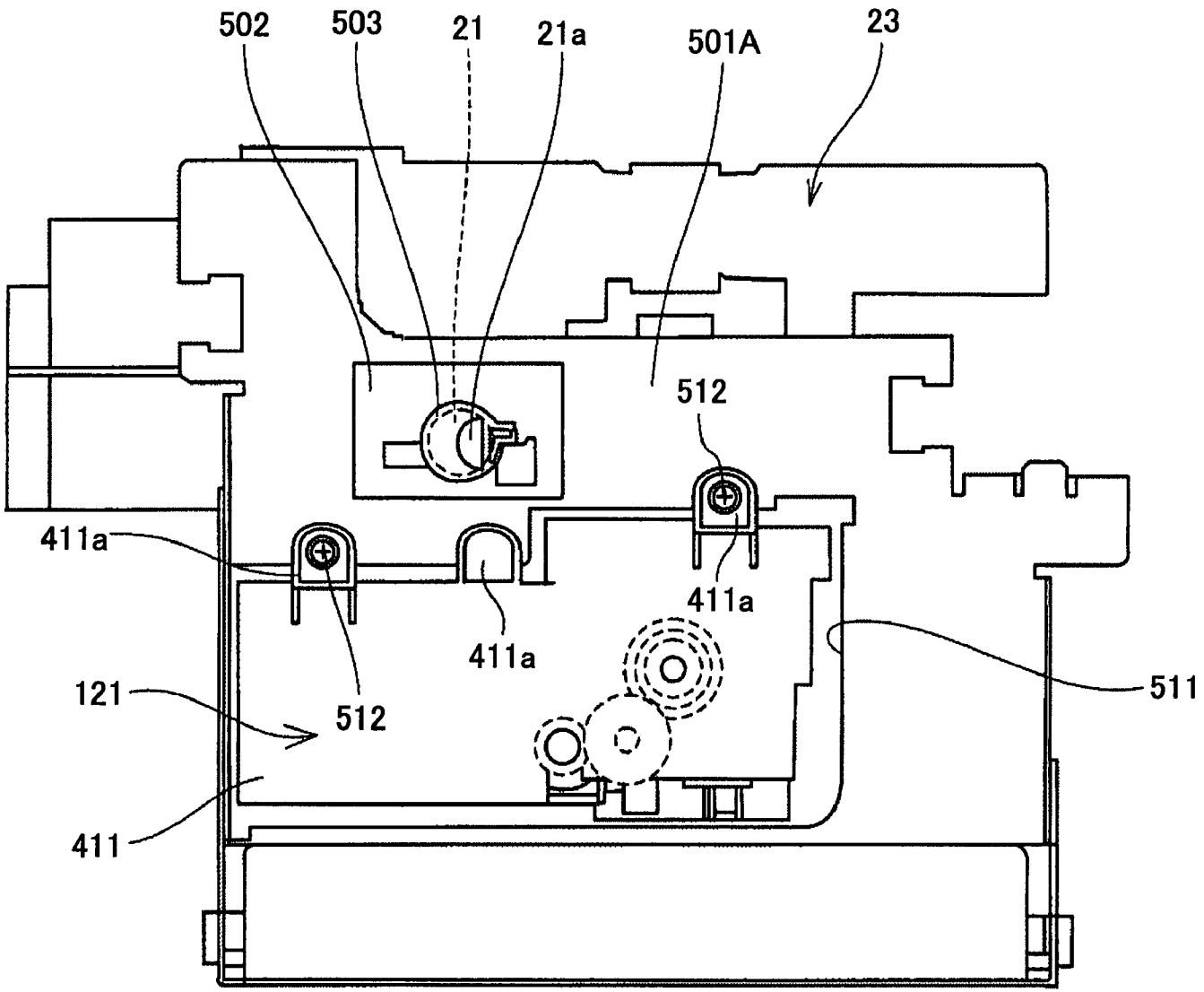
FIG. 7 is a side view illustrating a positional relation between the maintenance recovery mechanism and a side plate.
Figure 8:
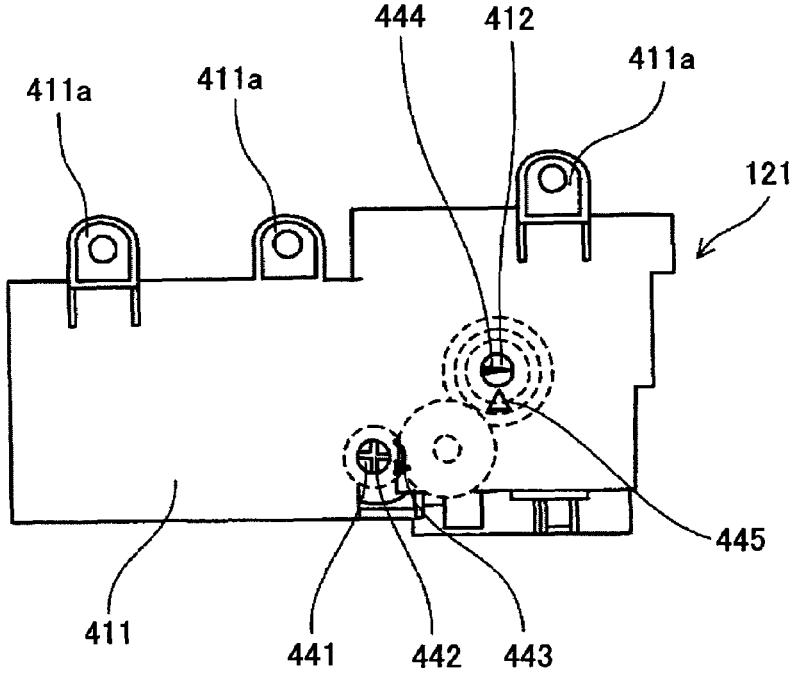
FIG. 8 is a side view illustrating the maintenance recovery mechanism.
Figure 9:
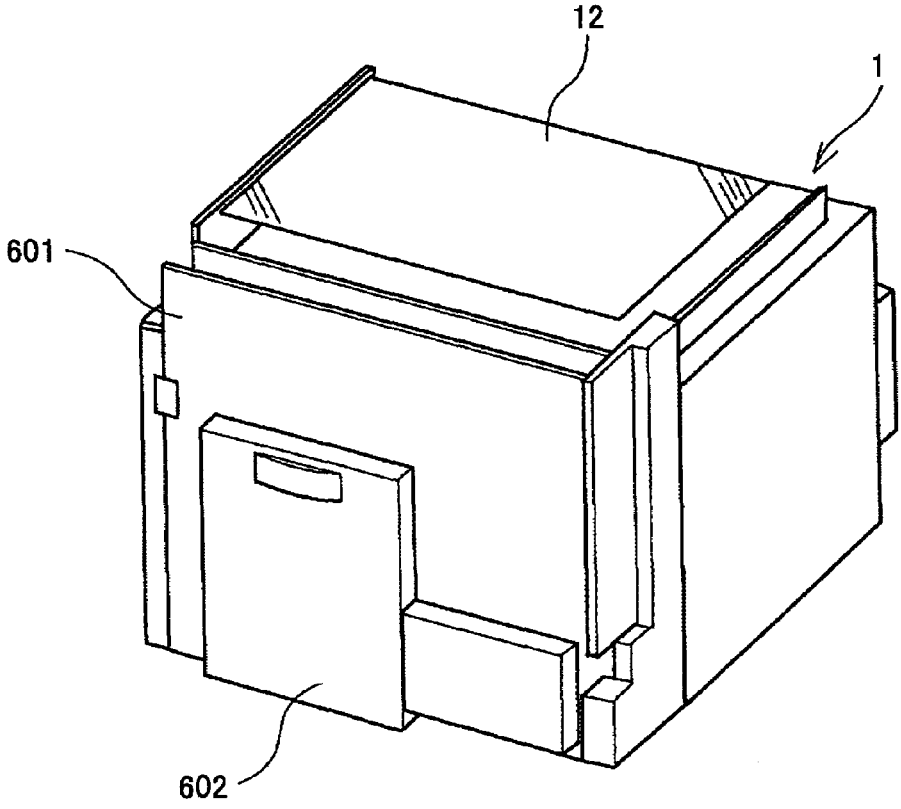
FIG. 9 is a perspective view illustrating the image forming apparatus.

The following describes a configuration for replacing the maintenance recovery mechanism 121 referring to FIGS. 7 through 9. FIG. 7 is a side view illustrating a positional relation between the maintenance recovery mechanism 121 and a side plate 501A. FIG. 8 is a side view illustrating the apparatus body 1. FIG. 9 is a perspective view illustrating the apparatus body 1.

Referring to FIG. 7, the guide rod 21, which guides a main scanning operation of the carriage 23, is attached at its ends to side plates 501A and 501B (FIG. 2). An end 21*a* of the guide rod 21 has a substantially semicircular cross section. The end 21*a* is attached to a holder member 503 rotatably held by an adjuster plate 502 fixed to the side plate 501A such that the height of the guide rod 21 or the distance between the carriage 23 and the sheet 5 can be adjusted by rotation of the holder member 503.

The side plate 501A has an opening 511 larger than the outline of the frame 411 of the maintenance recovery mechanism 121 at the lower side of a part where the guide rod 21 is attached so as to allow the maintenance recovery mechanism 121 to be removed toward a lateral side of the side plate 501A (lateral side of the apparatus body 1) for the purpose of replacement or for other purposes. In other words, the opening 511 is formed that has a size larger than the outline of a lateral projected area of the maintenance recovery mechanism 121. That is, the maintenance recovery mechanism 121 can pass through the opening 511. The end 21*a* of the guide rod 21 is attached to the side plate 501A at the upper side of the opening 511.

Flange sections 411*a* (see also FIG. 6) are formed integrally on the upper side of the frame 411 of the maintenance recovery mechanism 121. The flange sections 411*a* are secured to an outer face of the side plate 501A by fixing members 512 such as screws such that the maintenance recovery mechanism 121 is detachably secured to the side plate 501A at the upper side of the opening 511.

With this configuration, when the maintenance recovery mechanism 121 is removed toward the lateral side of the side plate 501A for the purpose of repair and replacement, etc., of the maintenance recovery mechanism 121, the fixing members 512 are removed to allow the maintenance recovery mechanism 121 to be separated from the side plate 501A and pulled out in the lateral direction through the opening 511 of the side plate 501A (in a direction indicated by an arrow A in FIG. 2). In this way, the maintenance recovery mechanism 121 can be removed.

As described above, by having an opening in a side plate larger than the outline of a frame of a maintenance recovery mechanism for removing the maintenance recovery mechanism toward the lateral side of the side plate, the maintenance recovery mechanism can be removed toward the lateral side (in a main scanning direction) without removing a guide rod and a carriage. This facilitates maintenance work including repair and replacement of the maintenance recovery mechanism.

By detachably attaching the frame of the maintenance recovery mechanism to the upper side of the opening, a positional relation between the carriage and the maintenance recovery mechanism can be stably maintained. Also by holding the end of the guide rod on the side plate at the upper side of the opening, a positional relation between the carriage and the maintenance recovery mechanism can be stably maintained.

The image forming apparatus may employ a system that causes a part of the carriage 23 to hit against the side plate 501A and detects that the carriage 23 has hit an object based on a signal change of the main scanning motor 27 and, with reference to this hitting position, moves the carriage 23 for a predetermined distance to a position, which is determined as a home position.

In this case, if the side plate 501A is deformed (but can be restored) when hit by the carriage 23, a positional relation between the home position of the carriage 23 and the maintenance recovery mechanism 121 might be changed. If the positional relation between the home position of the carriage 23 and the maintenance recovery mechanism 121 is changed, the positional relation between the recording head 24 of the carriage 23 and the dry-proof caps 122 or the suction cap 123 might be also changed.

When the relatively large opening 511 as described above for the removal of the maintenance recovery mechanism 121 is formed in the side plate 501A, the strength of the side plate 501 is lower compared to the one without the opening 511. If the maintenance recovery mechanism 121 is secured to the side plate 501A at the lower side of the opening 511 and the side plate 501A is deformed when hit by the carriage 23 for home position detection, a larger change of the positional relation between the home position of the carriage 23 and the maintenance recovery mechanism 121 is caused.

To avoid such a problem, the maintenance recovery mechanism 121 is secured to the side plate 501 at the upper side of the opening 511, and the end of the guide rod 21 is held by the side plate 501A at the upper side of the opening 511. With this configuration, even if the side plate 501A is deformed when the carriage 23 hits the side plate 501A at the upper side of the opening 511, a big change in the positional relation between the home position of the carriage 23 and the maintenance recovery mechanism 121 can be prevented. When the maintenance recovery mechanism 121 is secured to the side plate 501 at the upper side of the opening 511 and the end of the guide rod 21 is held by the side plate 501 at the upper side of the opening 511, the guide rod 21 is located close to a position where the maintenance recovery mechanism 121 is fixed. Accordingly, the change in the positional relation between the home position of the carriage 23 and the maintenance recovery mechanism 121 can be further minimized.

The following describes how engagement between the maintenance recovery mechanism 121 and the carriage 23 is released, referring to FIG. 8.

When the image forming apparatus is turned off, the carriage 23 is automatically moved toward the maintenance recovery mechanism 121 and locked by the carriage lock 415. Then, the ejection hole face of the recording head 24 is capped by the dry-proof caps 122 of the maintenance recovery mechanism 121.

When there is a need to remove the maintenance recovery mechanism 121 for the purpose of replacement or repair, etc., the engagement between the maintenance recovery mechanism 121 and the carriage 23 needs to be released for a smooth removal of the maintenance recovery mechanism 121. If the maintenance recovery mechanism 121 is removed by force without releasing the engagement, the ejection hole face of the recording head 24 might be damaged by friction with the dry-proof caps 122.

The maintenance recovery mechanism 121 is therefore configured such that the lock of the carriage and the capping of the recording head 24 are manually released. More specifically, with reference to FIG. 8, an end of a middle shaft 441, to which the clutch 437 is attached that transfers a drive force to the cam shaft 412 for vertically moving the caps 122, is exposed on the surface of the frame 411. A groove (which may be a recess or a projection without being limited to a groove) 442 to which a rotational operation member can be fitted is formed at the end of the middle shaft 441.

By fitting the rotational operation member such as a driver to the groove 442 of the middle shaft 441 and rotating the middle shaft 441, the cam shaft 412 is rotated. Thus, the carriage lock 415 is lowered, so the lock is released. Also, the caps 122 are brought out of the tight contact with the recording head 24. With these operations, the maintenance recovery mechanism 121 is removed.

Further, a mark 443 indicating a rotational direction is formed on a portion of the frame 411 near the middle shaft 441 in order to prevent the maintenance recovery mechanism 121 from being damaged due to rotation in a wrong direction. An end of the cam shaft 412 is also exposed on the surface of the frame 411. The position of the cam shaft 412 or the rotated amount of the cam shaft 412 is indicated by a mark 444 formed on an end face of the cam shaft 412 and a mark 445 formed on the surface of the frame 411 near the cam shaft 412.

With this configuration, a user can know how much and in which direction to rotate the cam shaft 412. Therefore, the user can correctly rotate the cam shaft 412 with ease to bring the recording head 24 and the caps 122 out of tight contact.

As described above, by having a maintenance recovery mechanism adapted to maintain a condition of the recording head and provided with a lock member for locking a carriage and a cap member, and by forming a groove or a projection at an end of a cam shaft of the maintenance recovery mechanism or a shaft connected to the cam shaft that lifts/lowers the lock member and the cap member, it is possible to release the lock of the carriage and bring the recording head and the cap member out of tight contact by manually rotating the cam shaft even when the power is not supplied.

The exterior of the image forming apparatus is described below in detail with reference to FIGS. 9 and 10.

The maintenance recovery mechanism 121 can be pulled out through the side plate 501A laterally in the main scanning direction as described above. In order to further pull out the maintenance recovery mechanism 121 to the outside of the apparatus body 1, a detachable exterior cover 602 is provided on a cover 601 at the rear side of the apparatus body 1 as shown in FIGS. 9 and 10. The exterior cover 602 is arranged at a position opposing the maintenance recovery mechanism 121 and a waste liquid tank 600 for holding waste liquid discharged from the maintenance recovery mechanism 121.

Figure 10:
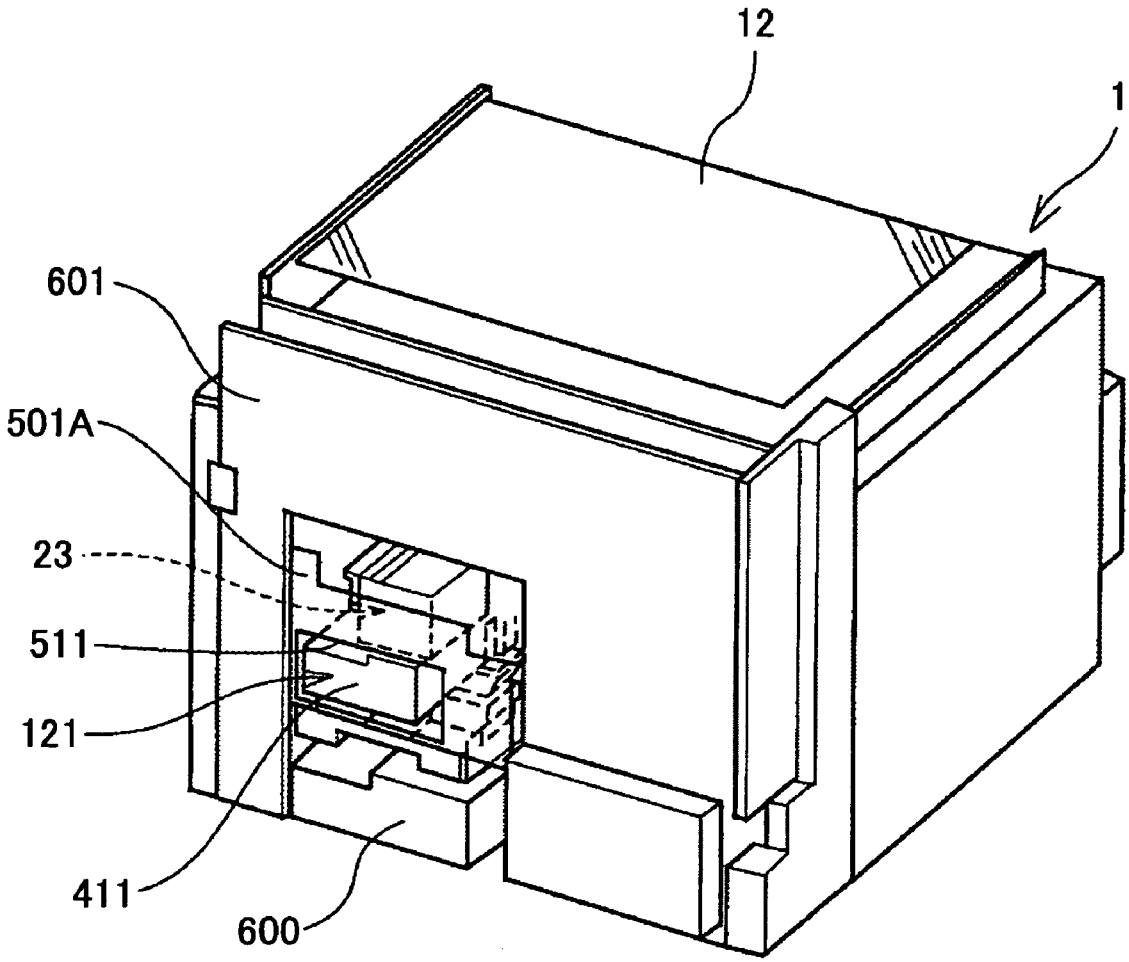
FIG. 10 is a perspective view illustrating the image forming apparatus with an exterior cover removed.

When the exterior cover 602 is detached from the cover 601, the maintenance recovery mechanism 121 and the waste liquid tank 600 arranged at the rear side of the apparatus body 1 are exposed as shown in FIG. 10. Therefore, the maintenance recovery mechanism 121 can be removed to the outside by separating the maintenance recovery mechanism 121 from the side plate 501A and pulling out the maintenance recovery mechanism 121 through the opening 511.

While the image forming apparatus exemplified in the above embodiment is the multifunction type image forming apparatus comprising an image reading unit, other types of image forming apparatuses and image forming apparatuses that use recording liquid other than ink may be applicable as the image forming apparatus of the present invention.

The present application is based on Japanese Priority Application No. 2004-260667 filed on Sep. 8, 2004, with the Japanese Patent Office, the entire contents of which are hereby incorporated by reference.

What is claimed is:

1. An image forming apparatus, comprising:

a carriage on which a recording head that ejects recording liquid is mounted;

a side plate;

a guide rod attached at an end to the side plate and adapted to guide the carriage in a main scanning direction; and a maintenance recovery mechanism disposed at an end side of a scanning area of the carriage and adapted to maintain a condition or the recording head, the maintenance recovery mechanism including a frame;

wherein an opening larger than an outline of the frame of the maintenance recovery mechanism is formed in the side plate such that the maintenance recovery mechanism is removed through the opening, the frame of the maintenance recovery mechanism is detachably secured to the side plate at an upper side of the opening, and a plurality of flange sections are formed integrally on an upper side of the frame of the maintenance recovery mechanism and are secured to an outer face of the side plate.

2. The image forming apparatus as claimed in claim 1, wherein the end of the guide rod is attached to the side plate at the upper side of the opening.

3. The image forming apparatus as claimed in claim 1, wherein a cover of an apparatus body is detachably attached to an outer side of the side plate.

4. The image forming apparatus as claimed in claim 1, further comprising:

an image reading unit; and an image forming unit including the recording head.

5. The image forming apparatus as claimed in claim 1, wherein when the carriage is caused to hit against the side plate at a first position, the carriage hitting against the side plate at the first position is detected based on a signal change of a main scanning motor configured to move the carriage in the main scanning direction, and the carriage is moved for a predetermined distance from the first position to a second position, the second position being determined as a home position of the carriage.

6. An image forming apparatus, comprising:

a carriage on which a recording head that ejects recording liquid is mounted;

a slide plate; and a maintenance recovery mechanism disposed at an end side of a scanning area of the carriage and configured to maintain a condition of the recording head, the maintenance: recovery mechanism including a frame;

wherein an opening larger than an outline of the frame of the maintenance recovery mechanism is formed in the side plate such that the maintenance recovery mechanism is removed through the opening, the frame of the maintenance recovery mechanism is detachably secured to the side plate at an upper side of the opening, and a plurality of flange sections are formed integrally on an upper side of the frame of the maintenance recovery mechanism and are secured to an outer face of the side plate.

* * * * *